US010076676B2

(12) United States Patent
Sawchyn

(10) Patent No.: US 10,076,676 B2
(45) Date of Patent: Sep. 18, 2018

(54) FLAME RESISTANT PROTECTIVE HEAD SHIELD

(71) Applicant: Edward Sawchyn, Victoria (CA)

(72) Inventor: Edward Sawchyn, Victoria (CA)

(73) Assignee: Cooler Heads Safety Inc., Victoria, British (CA)

( * ) Notice: Subject to any disclaimer, the term of this patent is extended or adjusted under 35 U.S.C. 154(b) by 215 days.

(21) Appl. No.: 15/035,826

(22) PCT Filed: Dec. 2, 2014

(86) PCT No.: PCT/CA2014/051157
§ 371 (c)(1),
(2) Date: May 11, 2016

(87) PCT Pub. No.: WO2015/081434
PCT Pub. Date: Jun. 11, 2015

(65) Prior Publication Data

US 2016/0296772 A1 Oct. 13, 2016

(30) Foreign Application Priority Data

Dec. 4, 2013 (CA) ..... 2836383

(51) Int. Cl.
*A62B 17/00* (2006.01)
*A62C 8/08* (2006.01)
(Continued)

(52) U.S. Cl.
CPC ..... *A62B 17/003* (2013.01); *A41D 1/002* (2013.01); *A41D 13/05* (2013.01);
(Continued)

(58) Field of Classification Search
CPC ..... A62B 17/003; A41D 1/002; A41D 13/05; A41D 31/0022; A62C 8/08; A62C 5/33344
(Continued)

(56) References Cited

U.S. PATENT DOCUMENTS 3,123,831 A * 3/1964 Welss et al. ..... A42B 3/0433 128/201.23
4,508,115 A 4/1985 Warncke
(Continued)

FOREIGN PATENT DOCUMENTS

| | | | |
|---|---|---|---|
| CA | 2 547 855 | A1 | 6/2005 |
| EP | 2 091 365 | B1 | 9/2010 |
| WO | 2007069100 | A1 | 6/2007 |

OTHER PUBLICATIONS

European Search Report issued in corresponding European Patent Application No. 14867959.0 dated Jun. 19, 2017.
(Continued)

*Primary Examiner* — Gloria Hale
(74) *Attorney, Agent, or Firm* — Davis & Bujold PLLC; Michael J. Bujold

(57) ABSTRACT

A flame resistant protective head shield includes a hollow body having a neck receptacle to facilitate the body being positioned around a neck of a wearer. The body has an exterior surface and an interior surface. The interior surface defines an interior cavity. An opening is provided in the exterior surface in communication with the interior cavity. A flexible flame resistant substrate is provided having a secured end and a free end. The secured end is secured to the body. The substrate is movable between a stored position within interior cavity and a deployed position in which the free end of the substrate extends through the opening and upwardly to cover a head of the wearer. A pressurized gas powered actuator is provided to move the substrate in a
(Continued)

fraction of a second from the stored position to the deployed position. A sensor is provided for detecting a flash fire coupled to the actuator. Deployment of the substrate by the actuator is triggered by the sensor sensing a flash fire.

10 Claims, 10 Drawing Sheets

(51) Int. Cl.
*A41D 1/00* (2018.01)
*A41D 13/05* (2006.01)
*A41D 31/00* (2006.01)

(52) U.S. Cl.
CPC ..... *A41D 31/0022* (2013.01); *A62C 8/08* (2013.01); *A41D 2400/42* (2013.01)

(58) Field of Classification Search
USPC ..... 2/7, 8.1
See application file for complete search history.

(56) References Cited

U.S. PATENT DOCUMENTS

| | | | | |
|---|---|---|---|---|
| 5,110,655 | A * | 5/1992 | Engler | A42B 3/061 2/5 |
| 5,133,344 | A * | 7/1992 | Jurrius | A62B 17/04 128/201.23 |
| 6,012,175 | A * | 1/2000 | Johnston | A62B 17/04 128/201.25 |
| 2007/0068520 | A1 | 3/2007 | Laib et al. | |

OTHER PUBLICATIONS

International Search Report Corresponding to PCT/CA2014/051157 dated Feb. 16, 2015.
Written Opinion Corresponding to PCT/CA2014/051157 dated Feb. 16, 2015.

* cited by examiner

FLAME RESISTANT PROTECTIVE HEAD SHIELD

FIELD

There is described a protective head shield to provide protection from flash fires.

BACKGROUND

In many industries there are regulations requiring that workers wear flame resistant clothing to protect them in the event of a flash fires from combustibles such as oil and gas, dust or electrical arc flash. The success or failure of any flame resistant clothing is determined by a percentage of body burn during a 3 second, staged, flash fire. Body burn is only considered significant when third degree burns are achieved. Second and First degree burns are not considered burns for this test. The head is not even considered in these calculations of body burn, but every simulation shows 100% third degree burns to the head and face area. This makes abundantly clear that there is a great need for protection for the head and face area.

U.S. Pat. No. 3,123,831 (Wells et al) entitled "deployable face mask" discloses one approach to protecting the head and face area.

SUMMARY

There is provided a flame resistant protective head shield which includes a hollow body having a neck receptacle to facilitate the body being positioned around a neck of a wearer. The body has an exterior surface and an interior surface. The interior surface defines an interior cavity. An opening is provided in the exterior surface in communication with the interior cavity. A flexible flame resistant substrate is provided having a secured end and a free end. The secured end is secured to the body. The substrate is movable between a stored position within interior cavity and a deployed position in which the free end of the substrate extends through the opening and upwardly to cover a head of the wearer. A pressurized gas powered actuator is provided to move the substrate in a fraction of a second from the stored position to the deployed position. A sensor is provided for detecting a flash fire coupled to the actuator. Deployment of the substrate by the actuator is triggered by the sensor sensing a flash fire.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
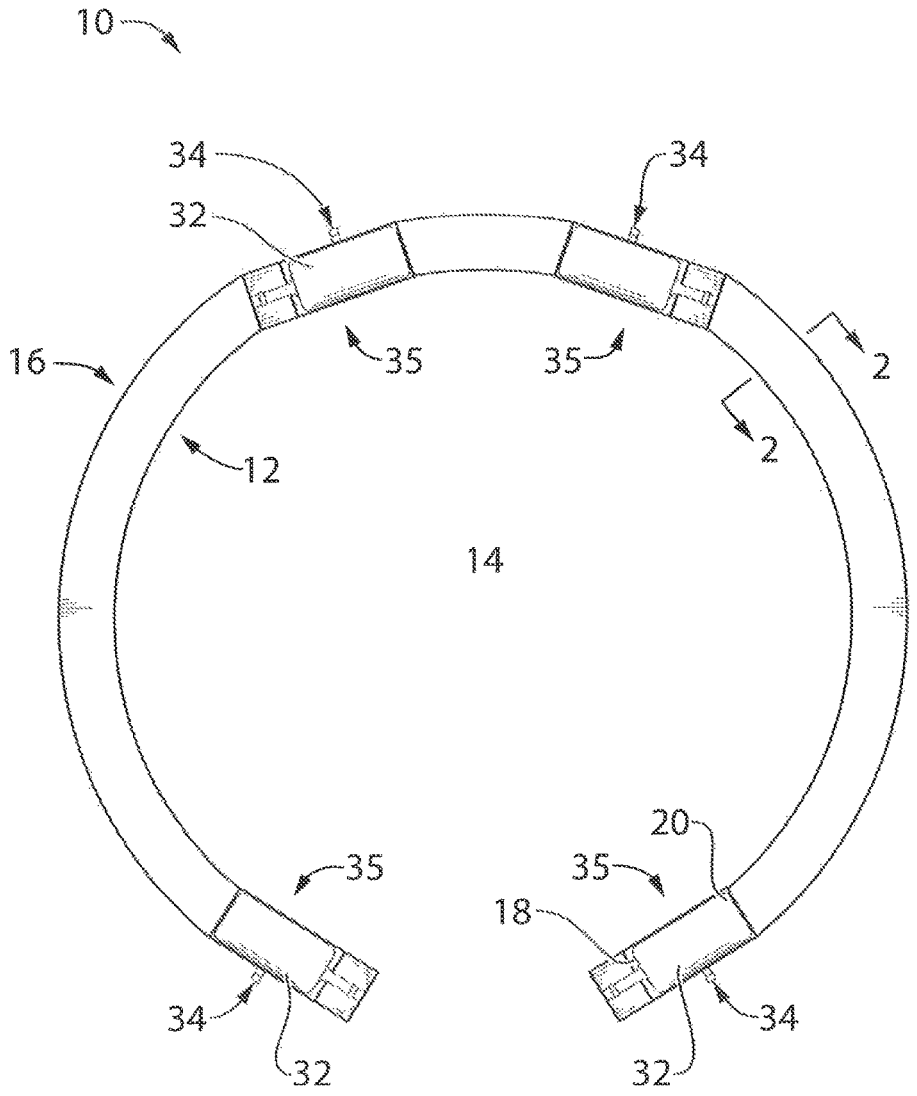
FIG. 1 is a top plan view, in partial section, of a flame resistant protective head shield with the flame resistant substrate in a stored position.

A flame resistant protective head shield, generally identified by reference numeral 10, will now be described with reference to FIG. 1 through FIG. 11. A commercial embodiment of flame resistant protective head shield, generally identified by reference numeral 200, will also be described with reference to FIG. 12 through FIG. 17.

Figure 2:
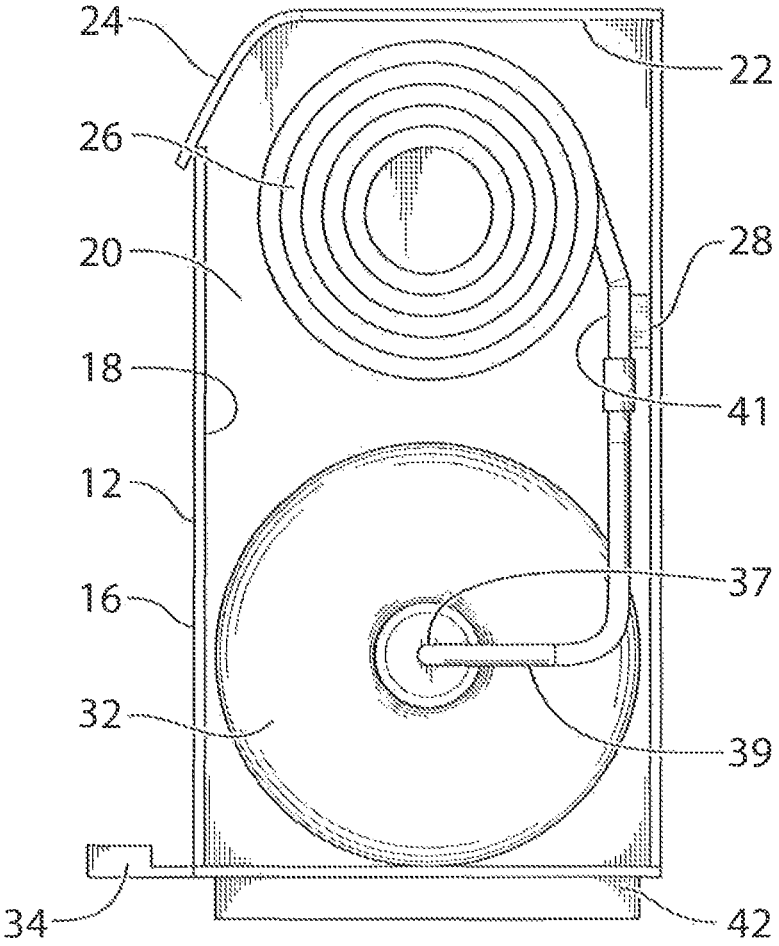
FIG. 2 is a cross-sectional end view taken along section lines 2-2 of the flame resistant protective head shield illustrated in FIG. 1.
Figure 3:
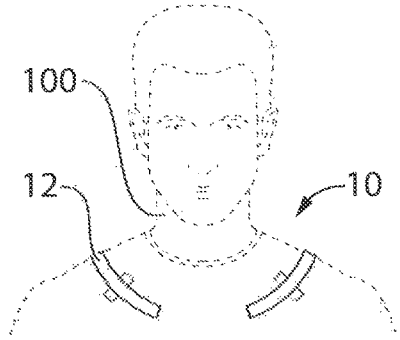
FIG. 3 is a front elevation view showing the flame resistant protective head shield illustrated in FIG. 1 positioned on a wearer.
Figure 4:
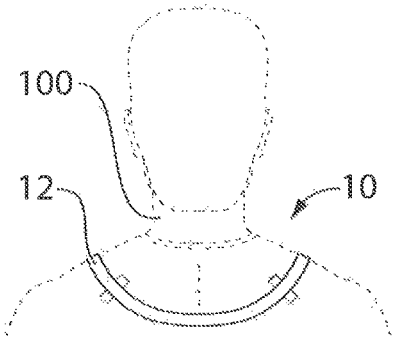
FIG. 4 is a rear elevation view showing the flame resistant protective head shield illustrated in FIG. 1 positioned on a wearer.

Structure and Relationship of Parts:

Referring to FIG. 1, head shield 10 includes a hollow body 12 having a neck receptacle 14 to facilitate body 12 being positioned around a neck 100 of a wearer 102, as had been illustrated in FIG. 3 and FIG. 4. Referring to FIG. 1, body 12 has an exterior surface 16 and an interior surface 18. The interior surface 18 defines an interior cavity 20. Referring to FIG. 2, an opening 22 is provided in exterior surface 16 in communication with interior cavity 20. It is preferred, but not essential, that opening 22 be closed by a closure 24, which will be moved out of the way during activation. A flexible flame resistant substrate 26 is provided. Referring to FIG. 11, substrate 26 has a secured end 28 and a free end 30. Secured end 28 is secured to body 12 and is divided into overlapping panels 26*a*, 26*b*, and 26*c*. Substrate 26 is movable between a stored position formed in a roll within interior cavity 20 illustrated in FIG. 2, FIG. 8 and a deployed position illustrated in FIG. 10, FIG. 11 in which free end 30 of substrate 26 extends through opening 22 and upwardly to cover a head 104 of wearer 102. Referring to FIG. 1, FIG.

Figure 5:
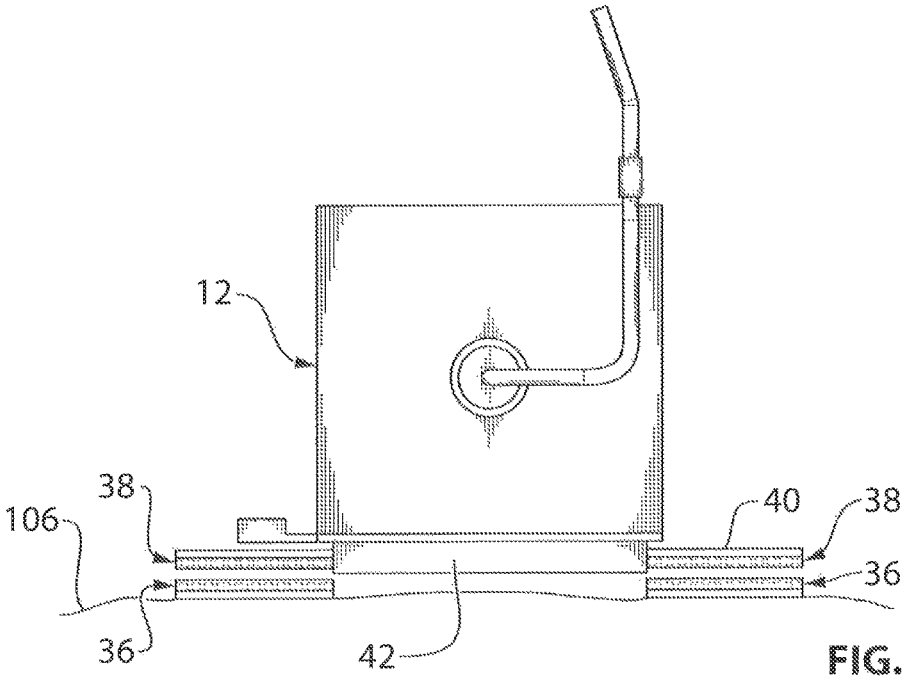
FIG. 5 is an end elevation view of the flame resistant protective head shield illustrated in FIG. 1 showing tape fastener attachment onto a garment of a wearer.
Figure 6:
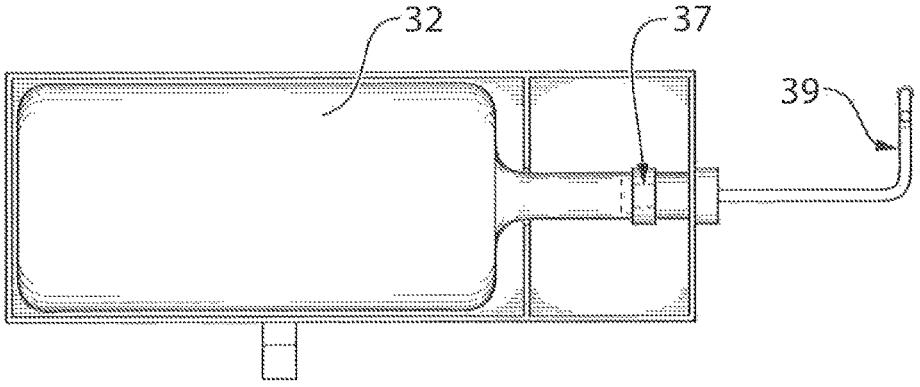
FIG. 6 is a detailed top plan view of the flame resistant protective head shield illustrated in FIG. 1 showing a gas cylinder mounting assembly.
Figure 7:
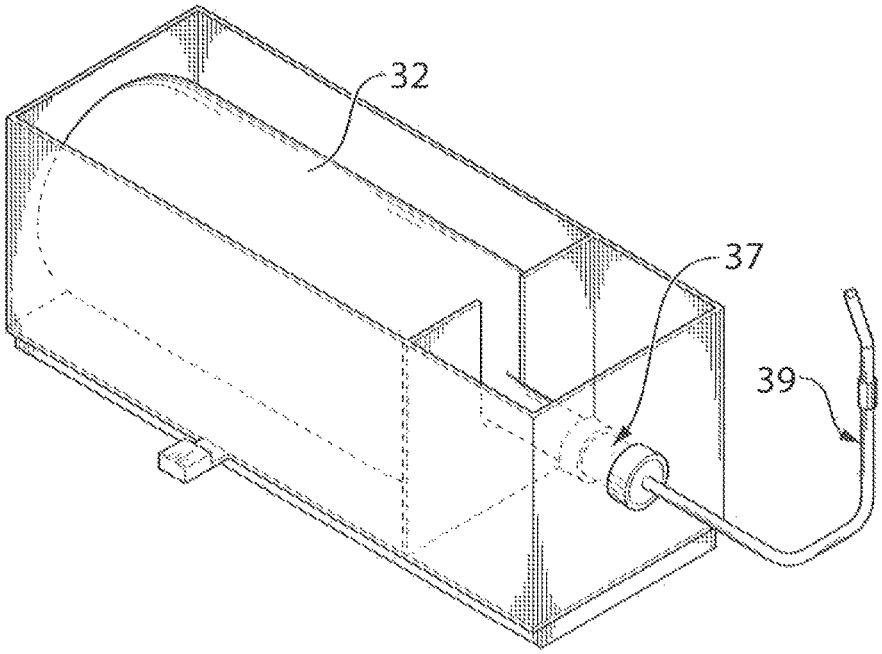
FIG. 7 is a detailed perspective view of the flame resistant protective head shield illustrated in FIG. 6 showing the gas cylinder mounting assembly.
Figure 10:
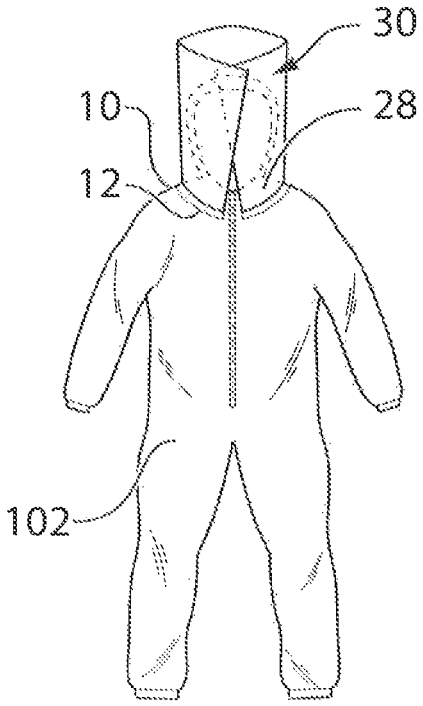
FIG. 10 is a front elevation view of a person wearing the flame resistant protective head shield illustrated in FIG. 1 with the flame resistant substrate in a deployed position.
Figure 11:
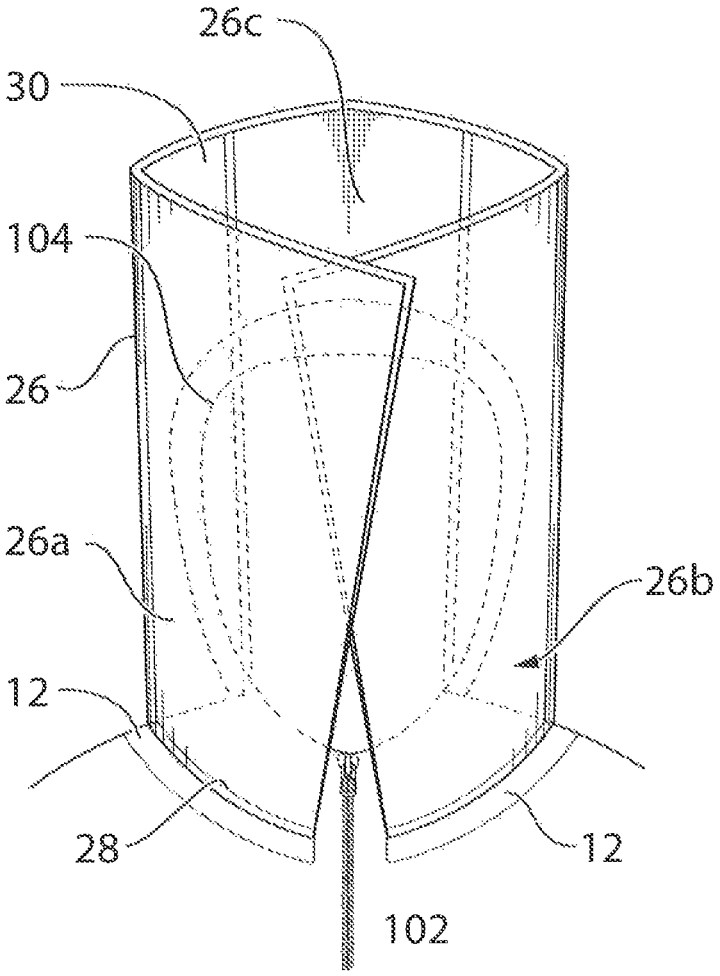
FIG. 11 is a perspective view of the flame resistant protective head shield illustrated in FIG. 10 with the flame resistant substrate in a deployed position.

6, and FIG. 7, a pressurized gas powered actuator is provided in the form of a series of networked gas cylinders 32 to move substrate 26 in a fraction of a second from the stored position illustrated in FIG. 2 to the deployed position illustrated in FIG. 10 and FIG. 11. Referring to FIG. 2, a sensor 34 for detecting a flash fire is coupled to gas cylinders 32. As will hereinafter be further described, deployment of substrate 26 by gas cylinders 32 is triggered by sensor 34 sensing a flash fire. Gas cylinder 32 has a trigger valve 37 with gas piping 39 that extends from gas cylinder 32 to an inflator conduit 41 that discharges into substrate 26. Referring to FIG. 5, it is preferred that body 12 be anchored to wearer 102. One way of doing this is by securing a first component 36 of a two part mating tape fastener system to garment 106 of wearer 102 and securing a second component 38 of a two part mating fastener system to body 12. This enables body 12 to be attached to garment 106 of wearer 102 by simply mating first component 36 and second component 38 of the two part mating fastener system. A commonly used two part mating fastener system in common commercial usage is sold under the Trademarked name VELCRO. For ease of assembly, second component 38 is carried by a mounting strip 40 which is received in a slotted mounting strip receiver 42 beneath body 12.

Figure 8:
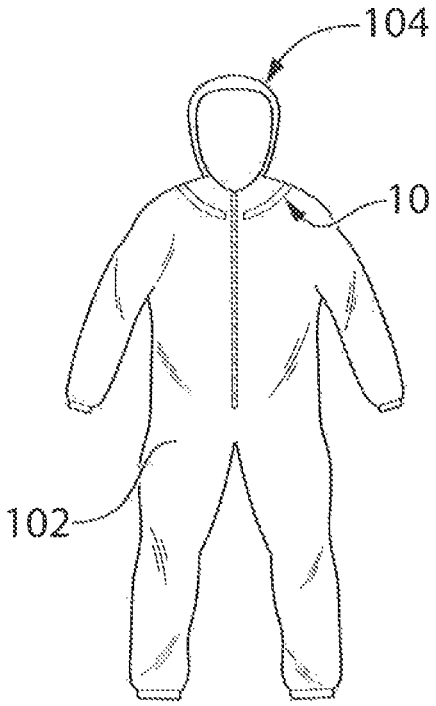
FIG. 8 is a front elevation view of a person wearing the flame resistant protective head shield illustrated in FIG. 1 with the flame resistant substrate in a stored position.
Figure 9:
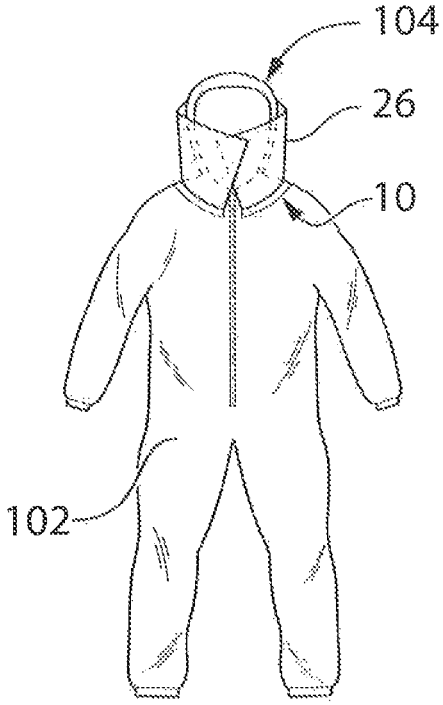
FIG. 9 is a front elevation view of a person wearing the flame resistant protective head shield illustrated in FIG. 1 with the flame resistant substrate in the process of moving from the stored position to the deployed position.

Operation:

Referring to FIG. 1 and FIG. 8, head shield 10 is positioned around a neck 100 of a wearer 102 with substrate in the stored position. It is preferred that head shield 10 be secured in position. Referring to FIG. 5, this is done by securing first component 36 of a two part mating tape fastener system to garment 106 of wearer 102 and securing second component 38 of the two part mating fastener system to body 12. Body 12 is attached to garment 106 of wearer 102 by simply mating first component 36 and second component 38 of the two part mating fastener system. Head shield 10 remains "passive" until sensor 34 detects the presence of heat. Referring to FIG. 9 and FIG. 10, substrate 26 of flame resistance fabric is then deployed upwards to protect head 104 of wearer 102. This movement of substrate 26 from the stored position illustrated in FIG. 8 to the deployed position illustrated in FIG. 10 is accomplished with the gas cylinders 32 illustrated in FIG. 1, FIG. 6 and FIG. 7.

The preferred form for body 12 is a flexible collar with a flexible rubber base acting as the foundation of the device. As described above this collar (body 12) is attached to garment 106 of wearer 102 via two part tape fasteners commercially available under the Trademark name VELCRO, for easy transfer between garments. The collar (body 12) houses the entire device which includes flame resistant fabric (substrate 26) rolled inward and treated with sodium bicarbonate or another flame retardant element to offer extra protection to the worker upon deployment. The flame resistant fabric (substrate 26) deploys upward and inward from both sides of the collar (body 12) to overlap and provide added facial protection, plus easy access to remove the flame resistant fabric (substrate 26) for visibility once clear of the danger. The flame resistant fabric (substrate 26) will be of lightweight material (such as is commercially available under the Trademark NOMEX) or Cotton/Poly blend to facilitate rapid deployment and a smaller cross section for the entire system. Referring to FIG. 1, the collar assembly (body 12) will house 4 gas cylinders 32 containing CO2 gas that will be connected to 4 inflatable deployment columns of flame resistant fabric (substrate 26) and 4 thermocouples (sensors 34). These are linked in parallel by electrical activation coupler 35 so that if one sensor is triggered, all 4 sensors will be triggered and all 4 gas cylinders will be activated to release their compressed gas to immediately inflate the deployment columns. The entire process will happen in less than 1 second to provide maximum protection and limit any burns to simple flash burns and not the crippling, disabling or disfiguring burns associated with second or third degree burns. The unit can be easily pulled down and out of the way by the worker if required and will automatically deflate when the compressed gas in the CO2 cylinders has been expended.

The concept is a passive head and face protection system that only activates when sensors are triggered by high levels of heat. The design is to have a Fire Resistant fabric rolled into a collar equipped with heat sensors, CO2 cylinders and expandable deployment columns. The collar is removable and can be used with any designed or retrofitted garment worn by workers. The fabric will be a light-weight FR fabric such as 5 oz. Nomex or other. The heat sensors will react immediately to a temperature spike of 100 degrees Celsius and will trigger the CO2 cylinders to release their gas into the expandable deployment columns. The expandable deployment columns will immediately inflate and extend the FR fabric up to protect the head and face from the flash fire. The fabric will be rolled in a Sodium Bicarbonate powder (or similar) to eliminate potential sticking of fabric and also be used as a flame retardant during deployment. The front of the system will deploy at an angle to allow for an overlap of the fabric to provide better facial protection, even when the collar of the garment being worn is not properly secured. It also allows for ease of removal when the fire danger has been averted.

Head shield 10 provides a number of advantages. Once it is secured to a garment of a worker, he or she likely won't even notice it and it won't restrict their movement. It will not make them uncomfortably hot when performing their day to day activities. It will not be taken off until their shift is over. It is transferable between garments, so it should last for quite a while.

Description of how the device works from installation, to deployment to removal.

1. Referring to FIG. 5, first component 36 (VELCRO Trademark) is be sewn onto garment 106 to allow for attachment of body 12 to garment 106. These loops will be 1"-2" wide and approximately 2"-3" long. A mounting strip 40 with second component 38 (VELCRO Trademark) is attached to body 12.

2. Body 12 has have 4 slots to allow mounting strip 40 to slide through and attach to second component 38 to first component 36. There will be 2 slots on the front of the unit and 2 slots on the back of the unit.

3. The above described mode of attachment allows for ease of removal when the garment 106 needs to be laundered and for ease of transfer when environmental, or other conditions require that another protective garment be worn.

4. Referring to FIG. 3 and FIG. 4, body 12 is easily attached to garment 106 and sits passively on the worker's shoulders as the worker conducts their duties. Body 12 is low profile, light and will not restrict the worker's movements. The worker will likely not even know that they are wearing this extra protective device.

5. Referring to FIG. 1 and FIG. 2, when there is a spike in temperature of 100 degrees Celsius, heat sensors 34 immediately activate the release of CO2 from gas cylinders 34.

6. Heat sensors 34 and gas cylinders 32 are connected in parallel so that the triggering of one sensor is the same as all of them being triggered and all 4 gas cylinders 32 release their compressed CO2 gas.

7. Referring to FIG. 8 through FIG. 11, upon the release of the compressed gas, the substrate 26 rolled into inflatable deployment columns (FIG. 3) immediately expand upwards and unroll substrate 26 (fire resistant fabric) as they do. The deployment phase is less than one second from the sensor being triggered to full deployment of the device.

8. When the device is fully deployed, the front inflatable deployment columns form panels 26*a*, 26*b*, 26*c* that overlap each other (see FIG. 11) which allows for facial protection and better protection in the event that the wearer does not have their garment fully closed at the collar.

9. During deployment, a powdered flame retardant substance (such as Sodium Bicarbonate) will be released as it is used during the packing and wrapping of the FR fabric. The reason for this is to extinguish any instantaneous flash burns before they become serious.

10. Once the unit it fully deployed, and the wearer has escaped the hazard, the fully deployed unit can be easily pulled down or separated at the front for visibility.

11. The unit will stay inflated and deployed until manually pulled down in case the wearer is rendered unconscious from the incident and additional flame protection may be required.

12. The fully deployed unit will not impede with breathing and the small amount of flame retardant powder will not cause any harm to the wearer.

13. The fully deployed unit will not impede the mobility of the wearer so they can readily escape the hazardous conditions.

Commercial Embodiment

In order to fully comply with "best mode" requirements a commercial embodiment of flame resistant protective head shield, generally identified by reference numeral 200, will be described with reference to FIG. 12 through FIG. 17. Where possible the same reference numerals used to describe flame resistant protective head shield 10 will be used to describe flame resistant protective head shield 200.

Figure 12:
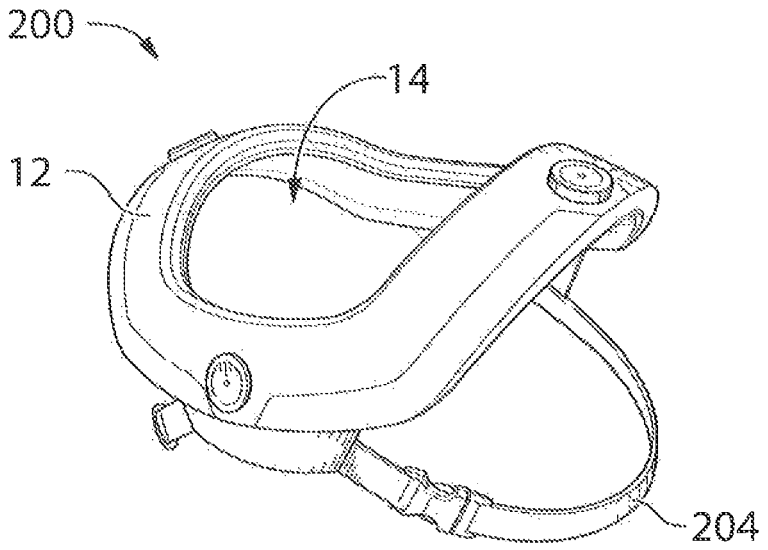
FIG. 12 is a perspective view of a commercial embodiment of the flame resistant protective head shield, with head shield stored.
Figure 13:
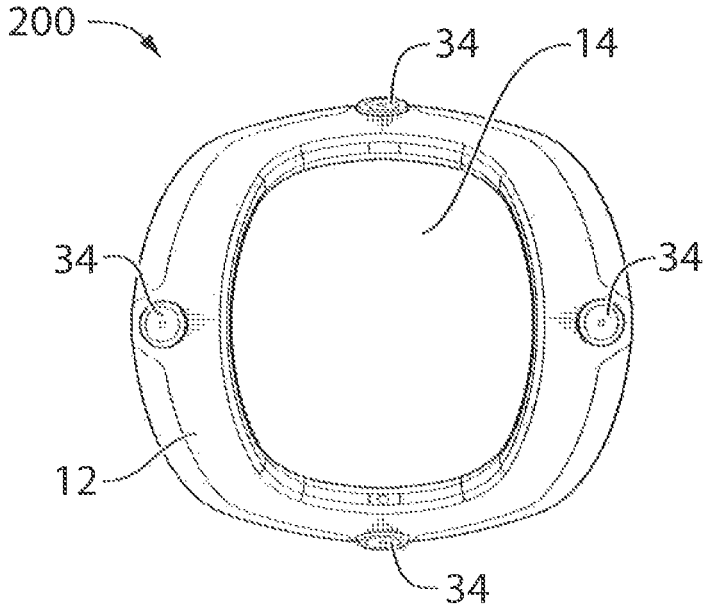
FIG. 13 is a top plan view of the flame resistant protective head shield of FIG. 12.
Figure 14:
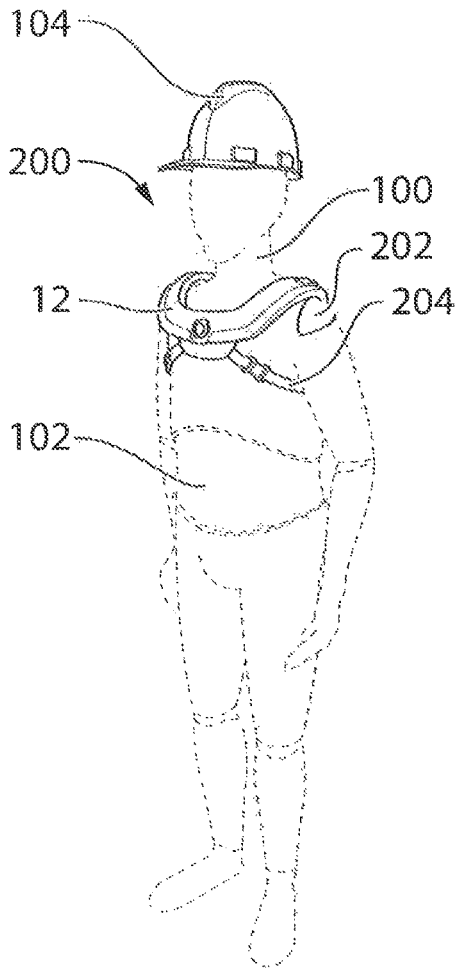
FIG. 14 is a perspective view of a person wearing the flame resistant protective head shield of FIG. 12, with the head shield in a stored position.
Figure 15:
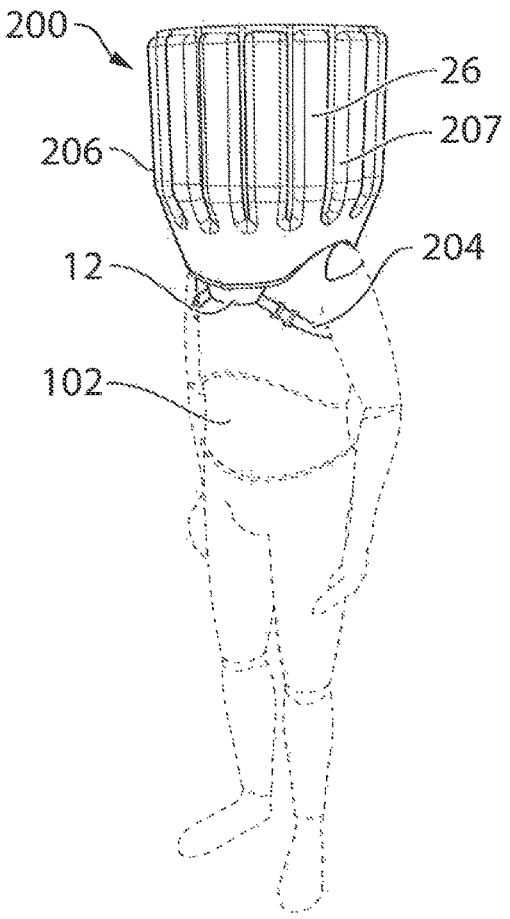
FIG. 15 is a perspective view of the flame resistant protective head shield of FIG. 12, with head shield deployed.
Figure 16:
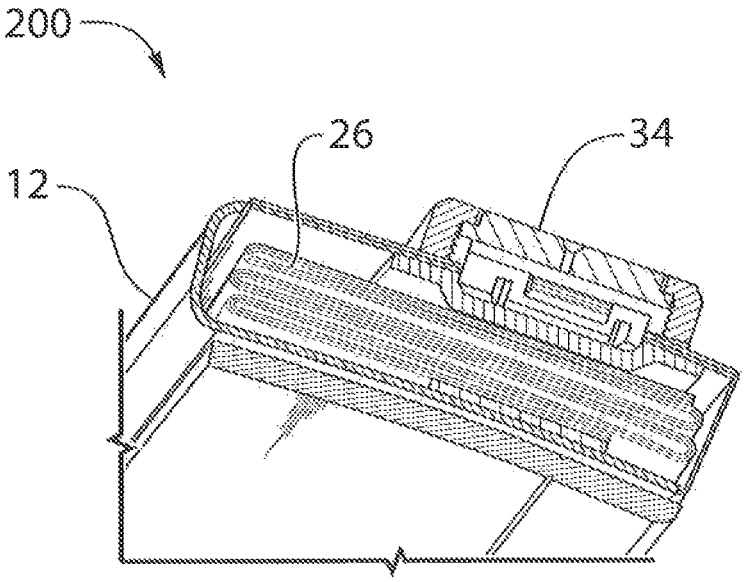
FIG. 16 is a perspective view in section of the flame resistant protective head shield of FIG. 12, showing substrate stored within.
Figure 17:
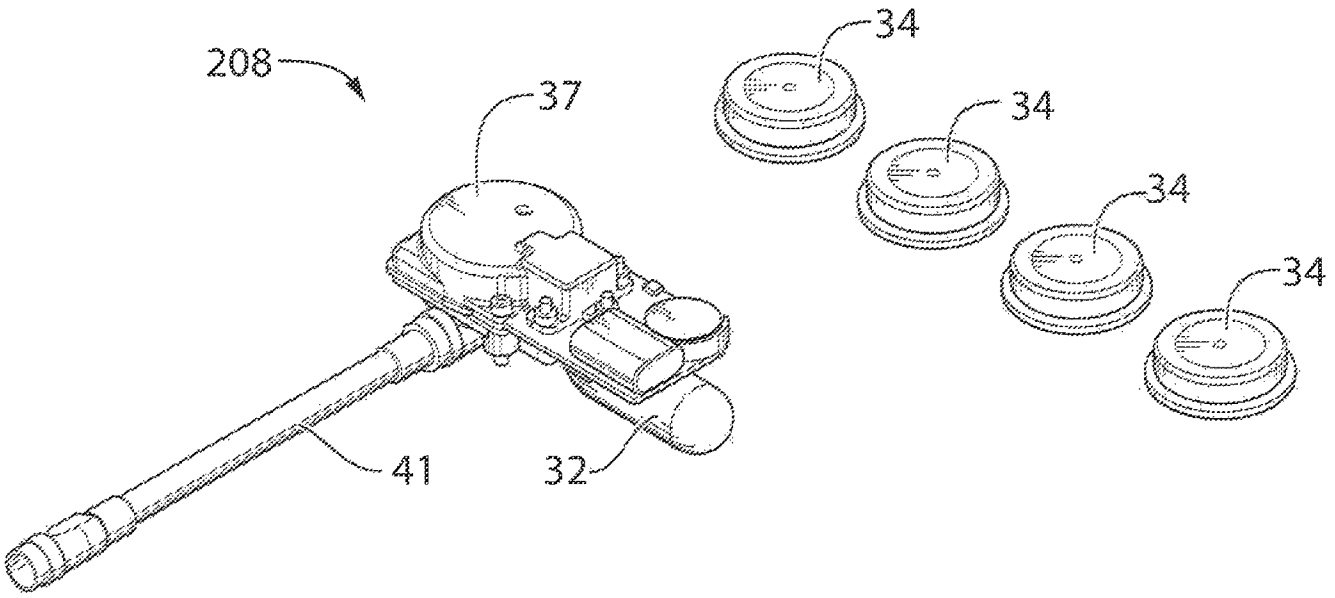
FIG. 17 is an exploded perspective view of an actuator assembly for the flame resistance protective head shield of FIG. 12.

Referring to FIG. 12, head shield 200 includes a hollow body 12 having a neck receptacle 14 to facilitate body 12 being positioned around a neck 100 of a wearer 102, as illustrated in FIG. 14. Body 12 for head shield 200 is in the form of a yoke that rests upon the shoulders 202 of wearer 102. Yoke body 12 is secured in position by straps 204. A flexible flame resistant substrate 26 is secured to yoke body 12 and is movable between a stored position and a deployed position. The deployed position is illustrated in FIG. 15. A difference with head shield 200 is the use of an inflatable support 206 having a plurality of spaced apart inflatable ribs 207. Inflatable support 206 was chosen for the head shield 200 as it helped address issues of even inflation rates and maintaining a consistent shape during deployment. Inflatable support 206 operates in a manner similar to air bag technology in automobiles. As inflatable support 206 moves from the stored position to the deployed position, it carries substrate 26. Referring to FIG. 16, it was found that having substrate 26 folded into a stack within yoke body 12 was less constrained for rapid deployment than the use of a roll. Referring to FIG. 17, an actuator assembly, generally identified by reference numeral 208, uses a single gas cylinder 32 to move inflatable support 206 carrying substrate 26 in a fraction of a second from the stored position illustrated in FIG. 14 to the deployed position illustrated in FIG. 15. Referring to FIG. 17, actuator assembly 208 is triggered by input from one of four thermal sensors 34. Referring to FIG. 13, thermal sensors 34 are positioned front, back, left side and right side of yoke body 12, so as to detect heat coming from any direction. Referring to FIG. 17, actuator assembly 208 has a solenoid trigger valve 37 that is actuated by a signal from thermal sensors 34 to cause gas cylinder 32 to move inflatable support 206 carrying substrate 26 from the stored position to the deployed position when heat indicative of a flash fire is detected by one of thermal sensors 34. Gas flows from gas cylinder 32 to an inflator conduit 41 that discharges into inflatable support 206. A portion of the gas may also be vented into the enclosure formed when inflatable support 206 is fully deployed. A "flash fire", typically, has a three second duration during which the flame passes. Referring to FIG. 15, when wearer 102 is no longer in immediate danger, wearer 102 tears substrate 26 away from inflatable support 206 or tears inflatable support 206 away from yoke body 12 and moves to safety.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A flame resistant protective head shield comprising:

a hollow body having a neck receptacle to facilitate the body being configured to be positioned around a neck of a wearer, the body having an exterior surface and an interior surface, the interior surface defining an interior cavity, and an opening being provided in the exterior surface in communication with the interior cavity;

a flexible flame resistant substrate having a secured end and a free end, the secured end is secured to the body, and the substrate being configured to be movable between a stored position within interior cavity and a deployed position in which the free end of the substrate extends through the opening and upwardly to cover a head of the wearer;

a pressurized gas powered actuator to move the substrate from the stored position to the deployed position; and a sensor for detecting a flash fire coupled to the actuator, and deployment of the substrate by the actuator being triggered by the sensor detecting a flash fire.

2. The flame resistant protective head shield of claim 1, wherein an inflatable support is provided that supports the substrate, the pressurized gas powered actuator moving the inflatable support from the stored position to the deployed position, with the substrate being carried by the inflatable support.

3. The flame resistant protective head shield of claim 1, wherein the actuator is a gas cylinder.

4. The flame resistant head shield of claim 3, wherein there is more than one gas cylinder arranged in series, such that activation of one gas cylinder triggers activation of all of the gas cylinders.

5. The flame resistant protective head shield of claim 1, wherein the substrate is coated with a powdered fire retardant.

6. The flame resistant protective head shield of claim 1, wherein the substrate is a flame resistant fabric.

7. The flame resistant protective head shield of claim 1, wherein the substrate has several overlapping panels that can be parted to provide visibility for the wearer between the panels.

8. The flame resistant protective head shield of claim 1, wherein in the stored position the substrate forms a roll.

9. The flame resistant protective head shield of claim 1, wherein the inflatable support is comprised of a plurality of spaced inflatable ribs.

10. The flame resistant protective head shield of claim 1, wherein in the stored position the substrate is folded into a stack.

* * * * *